US010486171B2

(12) United States Patent
Franca et al.

(10) Patent No.: US 10,486,171 B2
(45) Date of Patent: Nov. 26, 2019

(54) PROCESS FOR PRODUCING FLEXIBLE CONTAINER WITH MICROCAPILLARY DISPENSING SYSTEM

(71) Applicant: Dow Global Technologies LLC, Midland, MI (US)

(72) Inventors: Marcos Franca, Sao Paulo (BR); Bruno Rufato Pereira, Santana de Parnaiba (BR); Wenyi Huang, Midland, MI (US); Laura J. Dietsche, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 230 days.

(21) Appl. No.: 15/738,715

(22) PCT Filed: Jun. 24, 2016

(86) PCT No.: PCT/US2016/039243
§ 371 (c)(1),
(2) Date: Dec. 21, 2017

(87) PCT Pub. No.: WO2017/003859
PCT Pub. Date: Jan. 5, 2017

(65) Prior Publication Data

US 2018/0194504 A1 Jul. 12, 2018

Related U.S. Application Data

(60) Provisional application No. 62/186,103, filed on Jun. 29, 2015.

(51) Int. Cl.
*B65B 61/18* (2006.01)
*B65D 75/58* (2006.01)
(Continued)

(52) U.S. Cl.
CPC ..... *B05B 1/14* (2013.01); *B05B 11/047* (2013.01); *B65B 3/02* (2013.01); *B65B 61/18* (2013.01);
(Continued)

(58) Field of Classification Search
CPC ..... B65B 3/02; B65B 3/045; B65B 61/18; B65B 61/186; B65D 75/58; B65D 75/5811; B65D 75/5822; B05B 1/14; B05B 11/047
(Continued)

(56) References Cited

U.S. PATENT DOCUMENTS 2,864,108 A * 12/1958 Johnson ..... E04F 21/06 401/262
2,939,598 A * 6/1960 Donleavy ..... A61J 9/001 215/11.1
(Continued)

FOREIGN PATENT DOCUMENTS

EP 0811561 A1 * 12/1997 ..... B65D 75/5811
EP 1598281 A1 11/2005
(Continued)

*Primary Examiner* — Stephen F. Gerrity
(74) *Attorney, Agent, or Firm* — Quarles & Brady LLP

(57) ABSTRACT

The present disclosure provides a process. In an embodiment, a process for producing a flexible pouch is provided and includes placing a microcapillary strip between two opposing flexible films. The opposing flexible films define a common peripheral edge. The process includes positioning a first side of the microcapillary strip at a first side of the common peripheral edge and positioning a second side of the microcapillary strip at a second side of the common peripheral edge. The process includes first sealing, at a first seal condition, the microcapillary strip between the two flexible films; and second sealing, at a second seal condition,
(Continued)

a peripheral seal along at least a portion of the common peripheral edge. The peripheral seal includes a sealed micro-capillary segment.

16 Claims, 14 Drawing Sheets

(51) Int. Cl.
*B65B 3/02* (2006.01)
*B05B 1/14* (2006.01)
*B05B 11/04* (2006.01)

(52) U.S. Cl.
CPC ..... *B65D 75/5811* (2013.01); *B65D 75/5822* (2013.01)

(58) Field of Classification Search
USPC ..... 53/410, 412, 133.1–133.3, 133.5–133.8; 222/92, 107, 541.2, 541.6
See application file for complete search history.

(56) References Cited

U.S. PATENT DOCUMENTS 3,092,249 A * 6/1963 Chapman ..... B65D 81/18 206/210
3,208,640 A * 9/1965 Paulson ..... B65D 75/5822 222/94
3,418,059 A * 12/1968 Robe ..... B65D 75/5811 401/266
4,872,556 A * 10/1989 Farmer ..... B65D 75/5822 222/107
5,159,962 A * 11/1992 Dow ..... B65B 3/04 141/174
5,433,526 A * 7/1995 Wild ..... B65D 75/58 383/104
5,493,844 A * 2/1996 Combrink ..... B65B 51/146 53/410
5,783,638 A 7/1998 Lai et al.
6,769,579 B2 * 8/2004 Milian ..... B65D 83/0055 222/212
7,059,542 B2 * 6/2006 Garcia et al. ..... B65D 75/5883 222/107
7,517,484 B2 4/2009 Wu
8,641,946 B2 * 2/2014 Mackley et al. ..... B01D 63/066 264/177.16
2003/0075623 A1 * 4/2003 Bartels et al. ..... B05B 1/14 239/596
2003/0094466 A1 * 5/2003 Duquet et al. ..... B65D 75/5811 222/212
2003/0218024 A1 * 11/2003 Garcia et al. ..... B65D 75/5822 222/94
2004/0188461 A1 * 9/2004 Pennaneac'h et al. ..... B65D 75/58 222/103
2008/0193198 A1 8/2008 LaFlamme et al.
2009/0011182 A1 1/2009 Mackley et al.
2009/0139993 A1 6/2009 Last
2009/0206108 A1 8/2009 Lee
2011/0049038 A1 3/2011 Aerts et al.
2013/0011913 A1 1/2013 Edwards et al.
2013/0193472 A1 8/2013 Winkler et al.
2013/0209003 A1 * 8/2013 Hansen et al. ..... B65D 75/58 383/200
2013/0288016 A1 10/2013 Koopmans et al.
2013/0299607 A1 * 11/2013 Wilkerson et al. ..... B05B 17/0646 239/328
2014/0061235 A1 * 3/2014 Ankudinov ..... B65D 75/5805 222/107
2014/0113112 A1 4/2014 Koopmans et al.
2015/0014364 A1 1/2015 Greenfield et al.
2015/0321409 A1 11/2015 Dooley et al.
2015/0342875 A1 * 12/2015 Haffner ..... A61K 9/0051 604/890.1
2016/0016679 A1 1/2016 Pereira et al.

FOREIGN PATENT DOCUMENTS

EP 2186742 A1 5/2010
FR 2848996 A1 * 6/2004 ..... B65D 75/58
GB 2180214 A 3/1987
JP H06127561 A 5/1994
JP 2008-307502 A 12/2008
WO 2010/134083 A1 11/2010

* cited by examiner 50a
54
56a
52a
26
44
44
26
44
26
27
10
46a
22
26
44
46a 44
26
50a
46a
56
22
46a
10
44
52a
44
26
26
44
26
27

PROCESS FOR PRODUCING FLEXIBLE CONTAINER WITH MICROCAPILLARY DISPENSING SYSTEM

BACKGROUND

The present disclosure is directed to a process for producing a flexible pouch with a microcapillary dispensing system.

Flexible pouches are gaining market acceptance versus rigid packaging in many applications. In the food, home care, and personal care segments, flexible pouches offer the advantages of lower weight, efficient use and access to contents, good visual appeal, and better overall sustainability compared to rigid packaging.

Utilization of flexible pouches is still limited due to lack of specific functionalities, such as flow control, for example. Thus, flexible pouches are typically used as refill packages where the flexible pouch is opened and its contents poured into a previously used rigid container having a removable nozzle or spout. The nozzle or spout provides the rigid container with precision flow control.

Attempts for flow control in flexible pouches is achieved in stand-up pouches (SUPS) with the addition of a rigid fitment that is assembled to the SUP flexible structure by a heat-sealing process. These rigid fitments typically have a canoe shaped base that is placed between the films that form the SUP, the films are heat-sealed using a specialized heat seal bar that has the unique shape to accommodate the spout base. The heat sealing process is inefficient as it is slow, requiring specialized tooling. The heat sealing process is prone to significant amount of failures (leaks) due to the need for precise alignment of the spout between the films to the heat seal bars. The heat sealing process requires careful quality control, thus the high final cost of the fitment in a SUP makes it prohibitive for some low cost applications.

Rigid containers currently dominate the spray segment. Commonplace are rigid containers with specialized spray nozzles or trigger pump sprays for the application of familiar household products such as disinfectants, glass cleansers, and liquid waxes; personal care items such as creams, lotions, and sunscreen; and even food products such as salad dressings and sauces.

Despite the spray control afforded by such packaging systems, rigid containers are disadvantageous because they are heavy, expensive to produce, and the spray component is typically not recyclable.

The art recognizes the need for a flexible pouch that is capable of delivering its content by way of a spray application and without the need for a rigid spray component. A need further exists for a flexible container that is lightweight, recyclable and requires no rigid components.

SUMMARY

The present disclosure provides a process for producing a flexible pouch capable of delivering a spray—and without any rigid components.

The present disclosure provides a process. In an embodiment, a process for producing a flexible pouch is provided and includes placing a microcapillary strip between two opposing flexible films. The opposing flexible films define a common peripheral edge. The process includes positioning a first side of the microcapillary strip at a first side of the common peripheral edge and positioning a second side of the microcapillary strip at a second side of the common peripheral edge. The process includes first sealing, at a first seal condition, the microcapillary strip between the two flexible films, and second sealing, at a second seal condition, a peripheral seal along at least a portion of the common peripheral edge. The peripheral seal includes a sealed microcapillary segment.

The present disclosure provides another process. In an embodiment, a process for producing a flexible container is provided and includes placing a microcapillary strip at an edge offset distance between two opposing flexible films. The opposing films define a common peripheral edge. The process includes positioning a first side of the microcapillary strip at a first side of the common peripheral edge and positioning a second side of the microcapillary strip at a second side of the common peripheral edge. The process includes first sealing, at a first seal condition, the microcapillary strip between the two flexible films and second sealing, at a second seal condition, a peripheral seal along at least a portion of the common peripheral edge. The peripheral seal includes a sealed microcapillary segment.

An advantage of the present disclosure is the production of a pillow pouch, a sachet, or a flexible SUP that is capable of delivering a controlled spray of a liquid, without the need for a rigid spray component.

DEFINITIONS

Figure 1:
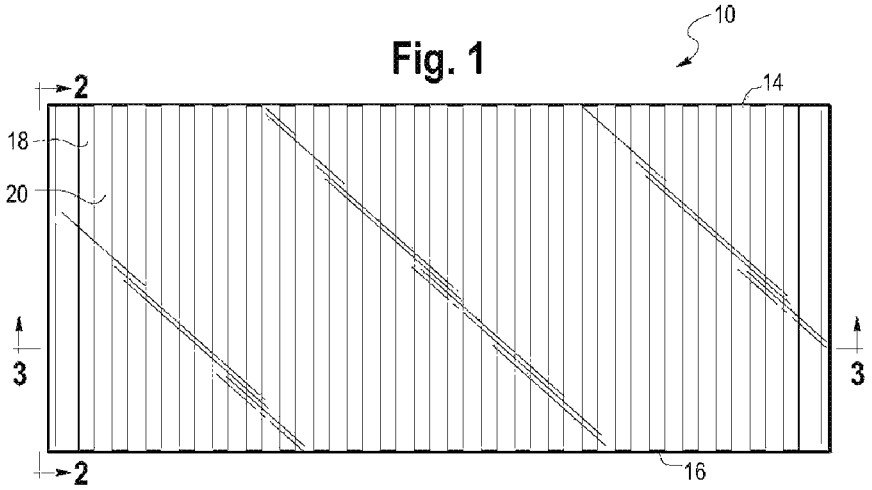
FIG. 1 is a top plan view of a microcapillary strip in accordance with an embodiment of the present disclosure.
Figure 2:
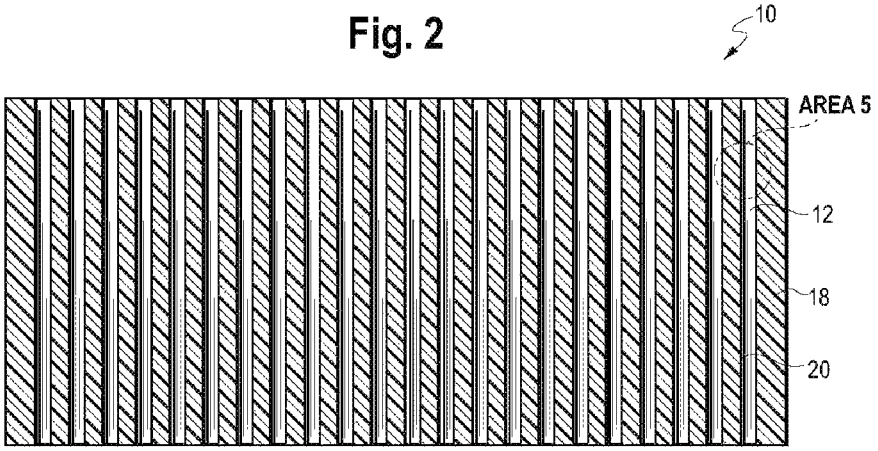
FIG. 2 is a longitudinal sectional view taken along line 2-2 of FIG. 1.

All references to the Periodic Table of the Elements herein shall refer to the Periodic Table of the Elements, published and copyrighted by CRC Press, Inc., 2003. Also, any references to a Group or Groups shall be to the Groups or Groups reflected in this Periodic Table of the Elements using the IUPAC system for numbering groups. Unless stated to the contrary, implicit from the context, or customary in the art, all parts and percents are based on weight. For purposes of United States patent practice, the contents of any patent, patent application, or publication referenced herein are hereby incorporated by reference in their entirety (or the equivalent US version thereof is so incorporated by reference), especially with respect to the disclosure of synthetic techniques, definitions (to the extent not inconsistent with any definitions provided herein) and general knowledge in the art.

The numerical ranges disclosed herein include all values from, and including, the lower value and the upper value. For ranges containing explicit values (e.g., 1 or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

Density is measured in accordance with ASTM D 792 with results reported as grams (g) per cubic centimeter (cc), or g/cc.

An "ethylene-based polymer," as used herein, is a polymer that contains more than 50 mole percent polymerized ethylene monomer (based on the total amount of polymerizable monomers) and, optionally, may contain at least one comonomer.

Melt flow rate (MFR) is measured in accordance with ASTM D 1238, Condition 280° C./2.16 kg (g/10 minutes).

Melt index (MI) is measured in accordance with ASTM D 1238, Condition 190° C./2.16 kg (g/10 minutes).

Shore A hardness is measured in accordance with ASTM D 2240.

Tm or "melting point," as used herein, (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

An "olefin-based polymer," as used herein, is a polymer that contains more than 50 mole percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 mole percent polymerized propylene monomer (based on the total amount of polymerizable monomers) and, optionally, may contain at least one comonomer.

DETAILED DESCRIPTION

The present disclosure provides a process. In an embodiment, a process for producing a flexible pouch is provided and includes placing a microcapillary strip between two opposing flexible films. The flexible films define a common peripheral edge. The process includes positioning a first side of the microcapillary strip at a first side of the common peripheral edge and positioning a second side of the microcapillary strip at a second side of the common peripheral edge. The process includes first sealing, at a first seal condition, the microcapillary strip between the two flexible films. The process includes second sealing, at a second seal condition, a peripheral seal along at least a portion of the common peripheral edge, the peripheral seal comprising a sealed microcapillary segment.

1. Microcapillary Strip

FIGS. 1-6 depict various views of a microcapillary strip 10 (or strip 10). The microcapillary strip 10 is composed of multiple layers (11*a*, 11*b*) of a polymeric material. While only two layers (11*a*, 11*b*) are depicted, the microcapillary strip 10 may include one, or three, or four, or five, or six, or more layers.

The microcapillary strip 10 has void volumes 12 and a first end 14 and a second end 16. The microcapillary strip 10 is composed of a matrix 18, which is a polymeric material. One or more channels 20 are disposed in the matrix 18. The channels 20 are arranged alongside and extend from the first end 14 to the second end 16 of the microcapillary strip 10. The channels 20 are positioned between the layers 11*a*, 11*b*. The number of channels 20 may be varied as desired. Each channel 20 has a cross-sectional shape. Nonlimiting examples of suitable cross-sectional shapes for the channels include oval, ovoid, circle, curvilinear, triangle, square, rectangle, star, diamond, and combinations thereof.

It is desired that the polymeric material has low shrink and release properties. In addition, it is recognized that a factor in the retention and/or ease of discharge of the liquid product stored in the flexible container is the surface tension between (i) the channel (or capillary) surfaces and (ii) the liquid content of the flexible container. Applicant discovered that altering the surface tension, or otherwise optimizing surface tension, for a particular use may improve performance of the flexible pouch. Nonlimiting examples of suitable methods to alter surface tension include material selection of the layers 11*a*,11*b* and/or matrix 18, addition of surface coatings to the layers 11*a*,11*b* and/or matrix 18, surface treatment of the layers 11*a*,11*b* and/or matrix 18 and/or the format channels 20 (i.e., corona treatment), and addition of additives, either to the layers 11*a*,11*b* and/or matrix 18, or to the liquid to be stored in the flexible container.

Figure 3:
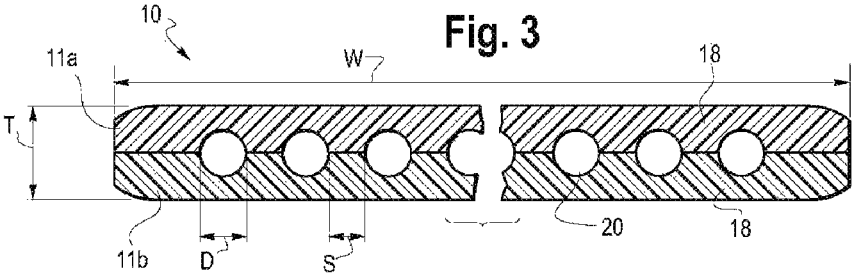
FIG. 3 is a cross sectional view taken along line 3-3 of FIG. 1.
Figure 4:
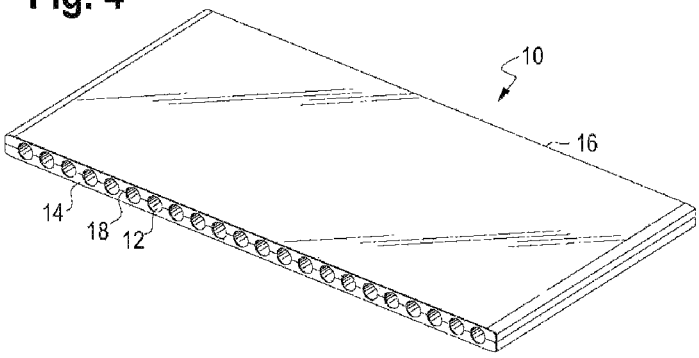
FIG. 4 is a perspective view of the microcapillary strip of FIG. 1.
Figure 5:
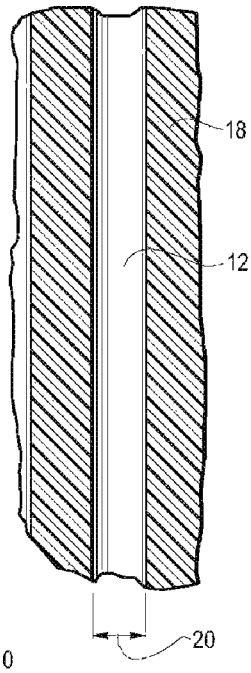
FIG. 5 is an enlarged view of Area 5 of FIG. 2.
Figure 6:
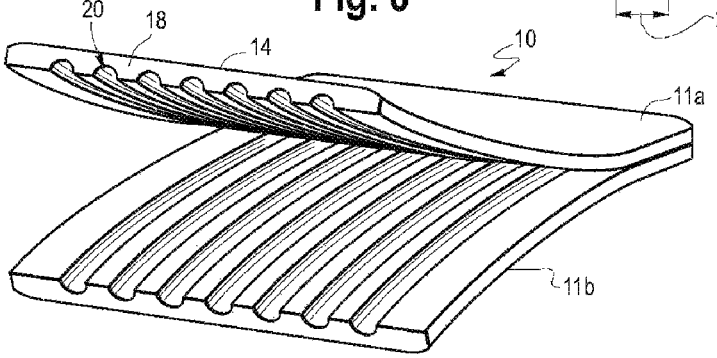
FIG. 6 is an exploded view of the microcapillary strip of FIG. 1.

The channels 20 have a diameter, D, as shown in FIG. 3. The term "diameter," as used herein, is the longest axis of the channel 20, from a cross-sectional view. In an embodiment, the diameter, D, is from 50 micrometer (μm), or 100 μm, or 150 μm, or 200 μm to 250 μm, or 300 μm, or 350 μm, or 400 μm, or 500 μm, or 600 μm, or 700 μm, or 800 μm, or 900 μm, or 1000 μm.

In an embodiment, the diameter, D, is from 300 μm, or 400 μm, or 500 μm to 600 μm, or 700 μm, or 800 μm, or 900 μm or 1000 μm.

The channels 20 may or may not be parallel with respect to each other. The term "parallel," as used herein, indicates the channels extend in the same direction and never intersect.

In an embodiment, the channels 20 are parallel.

In an embodiment, the channels 20 are not parallel, or are non-parallel.

A spacing, S, of matrix 18 (polymeric material) is present between the channels 20, as shown in FIG. 3. In an embodiment, the spacing, S, is from 1 micrometer (μm), or 5 μm, or 10 μm, or 25 μm, or 50 μm, or 100 μm, or 150 μm, or 200 μm to 250 μm, or 300 μm, or 350 μm, or 400 μm, or 500 μm, or 1000 μm, or 2000 μm or 3000 μm.

The microcapillary strip 10 has a thickness, T, and a width, W, as shown in FIG. 3. In an embodiment, the thickness, T, is from 10 μm, or 20 μm, or 30 μm, or 40 μm, or 50 μm, or 60 μm, or 70 μm, or 80 μm, or 90 μm, or 100 μm to 200 μm, or 500 μm, or 1000 μm, or 1500 μm, or 2000 μm.

In an embodiment, the short axis of the microcapillary strip 10 is from 20%, or 30%, or 40%, or 50% to 60% to 70% to 80% of the thickness, T. The "short axis" is the shortest axis of the channel 20 from the cross section point of view. The shortest axis is typically the "height" of the channel considering the microcapillary strip in a horizontal position.

In an embodiment, the microcapillary strip 10 has a thickness, T, from 50 μm, or 60 μm, or 70 μm, or 80 μm, or 90 μm, or 100 μm to 200 μm, or 500 μm, or 1000 μm, or 1500 μm, or 2000 μm. In a further embodiment, the microcapillary strip has a thickness, T, from 600 μm to 1000 μm.

In an embodiment, the microcapillary strip 10 has a width, W, from 0.5 centimeter (cm), or 1.0 cm, or 1.5 cm, or 2.0 cm, or 2.5 cm, or 3.0 cm, or 5.0 cm to 8.0 cm, or 10.0 cm, or 20.0 cm, or 30.0 cm, or 40.0 cm, or 50.0 cm, or 60.0 cm, or 70.0 cm, or 80.0 cm, or 90.0 cm, or 100.0 cm.

In an embodiment, the microcapillary strip 10 has a width, W, from 0.5 cm, or 1.0 cm, or 2.0 cm to 2.5 cm, or 3.0 cm, or 4.0 cm, or 5.0 cm.

In an embodiment, the channels 20 have a diameter, D, from 300 μm to 1000 μm; the matrix 18 has a spacing, S, from 300 μm to 2000 μm; and the microcapillary strip 10 has a thickness, T, from 50 μm to 2000 μm and a width, W, from 1.0 cm to 4.0 cm.

The microcapillary strip 10 may comprise at least 10 percent by volume of the matrix 18, based on the total volume of the microcapillary strip 10; for example, the microcapillary strip 10 may comprise from 90 to 10 percent by volume of the matrix 18, based on the total volume of the microcapillary strip 10; or in the alternative, from 80 to 20 percent by volume of the matrix 18, based on the total volume of the microcapillary strip 10; or in the alternative, from 80 to 30 percent by volume of the matrix 18, based on the total volume of the microcapillary strip 10; or in the alternative, from 80 to 50 percent by volume of the matrix 18, based on the total volume of the microcapillary strip 10.

The microcapillary strip 10 may comprise from 10 to 90 percent by volume of voidage, based on the total volume of the microcapillary strip 10; for example, the microcapillary strip 10 may comprise from 20 to 80 percent by volume of voidage, based on the total volume of the microcapillary strip 10; or in the alternative, from 20 to 70 percent by volume of voidage, based on the total volume of the microcapillary strip 10; or in the alternative, from 20 to 50 percent by volume of voidage, based on the total volume of the microcapillary strip 10.

The matrix 18 is composed of one or more polymeric materials. Nonlimiting examples of suitable polymeric materials include ethylene/$C_3$-$C_{10}$ α-olefin copolymers linear or branched; ethylene/$C_4$-$C_{10}$ α-olefin copolymers linear or branched; propylene-based polymer (including plastomer and elastomer, random propylene copolymer, propylene homopolymer, and propylene impact copolymer); ethylene-based polymer (including plastomer and elastomer, high density polyethylene (HDPE); low density polyethylene (LDPE); linear low density polyethylene (LLDPE); medium density polyethylene (MDPE)); ethylene-acrylic acid or ethylene-methacrylic acid and their ionomers with zinc, sodium, lithium, potassium, magnesium salts; ethylene-vinyl acetate (EVA) copolymers; and blends thereof.

In an embodiment, the matrix 18 is composed of one or more of the following polymers: enhanced polyethylene resin ELITE™ 5100G with a density of 0.92 g/cc by ASTM D792, a Melt Index of 0.85 g/10 min@190° C., 2.16 kg by ASTM D1238, and melt temperature of 123° C.; low density polyethylene resin DOW™ LDPE 5011 with a density of 0.922 g/cc by ASTM D792, a Melt Index of 1.9 g/10 min@190° C., 2.16 kg, and a melting temperature of 111° C.; high density polyethylene resin UNIVAL™ DMDA-6400 NT7 with a density of 0.961 g/cc by ASTM D792, a Melt Index of 0.8 g/10 min@190° C., 2.16 kg, and a melting temperature of 111° C.; polypropylene Braskem™ PP H314-02Z with a density of 0.901 g/cc by ASTM D792, a Melt Index of 2.0 g/10 min@230° C., 2.16 kg, and a melting temperature of 163° C.; ethylene/$C_4$-$C_{12}$ α-olefin multi-block copolymer such INFUSE™ 9817, INFUSE™ 9500, INFUSE™ 9507, INFUSE™ 9107, and INFUSE™ 9100 available from The Dow Chemical Company.

2. Flexible Film

Figure 7:
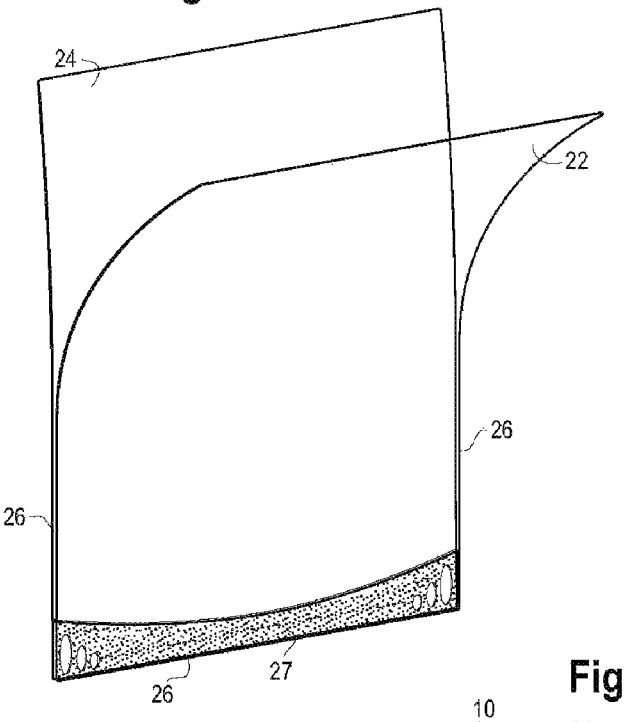
FIG. 7 is a perspective view of two flexible films in accordance with an embodiment of the present disclosure.
Figure 8:
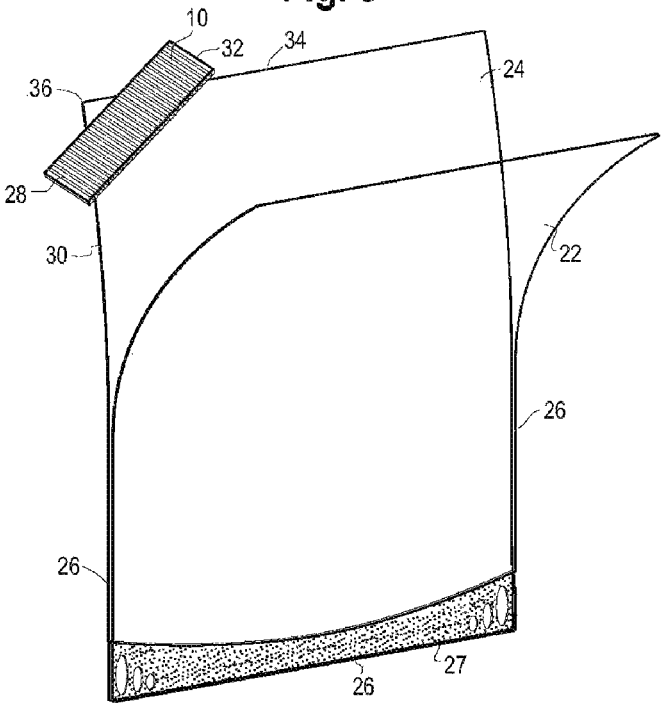
FIG. 8 is a perspective view of a microcapillary strip placed between two flexible films in accordance with an embodiment of the present disclosure.
Figure 15:
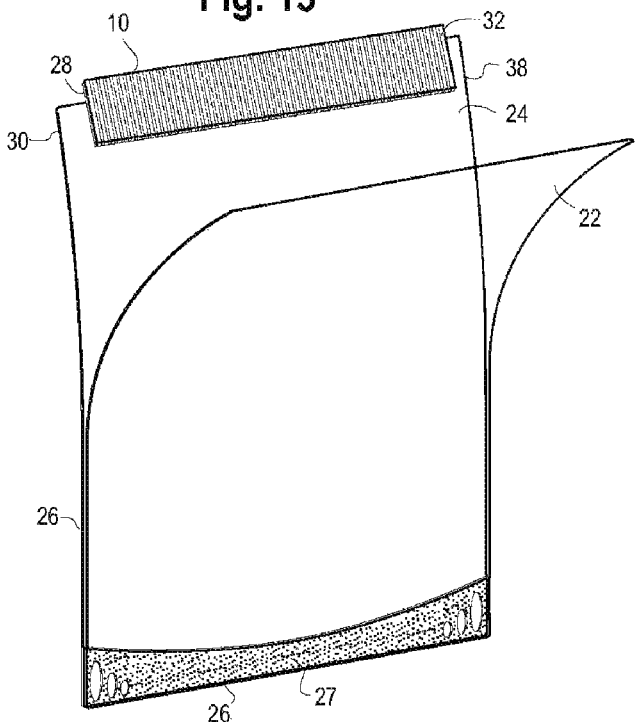
FIG. 15 is a perspective view of a microcapillary strip placed between two flexible films in accordance with an embodiment of the present disclosure.

The present process includes placing the microcapillary strip 10 between two opposing flexible films 22, 24 as shown in FIGS. 7-8 and 15. Each flexible film can be a monolayer film or a multilayer film. The two opposing films may be components of a single (folded) sheet/web, or may be separate and distinct films. The composition and structure of each flexible film can be the same or different.

In an embodiment, the two opposing flexible films 22, 24 are components of the same sheet or film, wherein the sheet is folded upon itself to form the two opposing films. The three unconnected edges can then be sealed, or heat sealed, after the microcapillary strip 10 is placed between the folded-over films.

In an embodiment, each flexible film 22, 24 is a separate film and is a flexible multilayer film having at least one, or at least two, or at least three layers. The flexible multilayer film is resilient, flexible, deformable, and pliable. The structure and composition for each of the two flexible multilayer films may be the same or different. For example, each of the two flexible films can be made from a separate web, each web having a unique structure and/or unique composition, finish, or print. Alternatively, each of two flexible films 22, 24 can be the same structure and the same composition, or from a single web.

In an embodiment, flexible film 22 and flexible film 24 each is a flexible multilayer film having the same structure and the same composition from a single web.

Each flexible multilayer film 22, 24 may be (i) a coextruded multilayer structure, (ii) a laminate, or (iii) a combination of (i) and (ii). In an embodiment, each flexible multilayer film 22, 24 has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or ten, or eleven, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

The flexible multilayer film is composed of one or more polymeric materials. Nonlimiting examples of suitable polymeric materials for the seal layer include olefin-based polymer including any ethylene/$C_3$-$C_{10}$ α-olefin copolymers linear or branched; ethylene/$C_4$-$C_{10}$ α-olefin copolymers linear or branched; propylene-based polymer (including plastomer and elastomer, random propylene copolymer, propylene homopolymer, and propylene impact copolymer); ethylene-based polymer (including plastomer and elastomer, high density polyethylene (HDPE); low density polyethylene (LDPE); linear low density polyethylene (LLDPE); medium density polyethylene (MDPE)); ethylene-acrylic acid or ethylene-methacrylic acid and their ionomers with zinc, sodium, lithium, potassium, magnesium salts; ethylene-vinyl acetate (EVA) copolymers; and blends thereof.

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (OPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6; Nylon 6,6; Nylon 6,66; Nylon 6,12; Nylon 12; etc.), polyethylene norbornene, cyclic olefin copolymers, polyacrylonitrile, polyesters, copolyesters (such as polyethylene terephthalate glycol-modified (PETG)), cellulose esters, polyethylene and copolymers of ethylene (e.g., LLDPE based on ethylene octene copolymer such as DOWLEX™), blends thereof, and multilayer combinations thereof.

Nonlimiting examples of suitable polymeric materials for the tie layer include functionalized ethylene-based polymers such as ethylene-vinyl acetate (EVA) copolymer; polymers with maleic anhydride-grafted to polyolefins such as any polyethylene, ethylene-copolymers, or polypropylene; and ethylene acrylate copolymers such an ethylene methyl acrylate (EMA); glycidyl containing ethylene copolymers; propylene- and ethylene-based olefin block copolymers such as INFUSE™ (ethylene-based Olefin Block Copolymers available from the Dow Chemical Company) and INTUNE™ (PP-based Olefin Block Copolymers available from The Dow Chemical Company); and blends thereof.

The flexible multilayer film may include additional layers which may contribute to the structural integrity or provide specific properties. The additional layers may be added by direct means or by using appropriate tie layers to the adjacent polymer layers. Polymers which may provide additional performance benefits such as stiffness, toughness or opacity, as well polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN™ resins available from The Dow Chemical Company); vinylethylene vinyl alcohol (EVOH) copolymer; and metal foil (such as aluminum foil). Alternatively, modified polymeric films such as vapor deposited aluminum or silicon oxide on such films as BON, OPET, or OPP, can be used to obtain barrier properties when used in laminate multilayer film.

In an embodiment, the flexible multilayer film includes a seal layer selected from LLDPE (sold under the trade name DOWLEX™ (The Dow Chemical Company)); single-site LLDPE substantially linear, or linear ethylene alpha-olefin copolymers, including polymers sold under the trade name AFFINITY™ or ELITE™ (The Dow Chemical Company) for example; propylene-based plastomers or elastomers such as VERSIFY™ (The Dow Chemical Company); and blends thereof. An optional tie layer is selected from either ethylene-based olefin block copolymer INFUSE™ Olefin Block Copolymer (available from The Dow Chemical Company) or propylene-based olefin block copolymer such as INTUNE™ (available from The Dow Chemical Company), and blends thereof. The outer layer includes greater than 50 wt % of resin(s) having a melting point, Tm, that is from 25° C. to 30° C., or 40° C. higher than the melting point of the polymer in the seal layer wherein the outer layer polymer is comprised of resins such as DOWLEX™ LLDPE, ELITE™ enhanced polyethylene resin, MDPE, HDPE, or a propylene-based polymer such as VERSIFY™, VISTAMAX™, propylene homopolymer, propylene impact copolymer, or TPO.

In an embodiment, the flexible multilayer film is coextruded.

In an embodiment, flexible multilayer film includes a seal layer selected from LLDPE (sold under the trade name DOWLEX™ (The Dow Chemical Company)); single-site LLDPE (substantially linear, or linear, olefin polymers, including polymers sold under the trade name AFFINITY™ or ELITE™ (The Dow Chemical Company) for example); propylene-based plastomers or elastomers such as VERSIFY™ (The Dow Chemical Company); and blends thereof. The flexible multilayer film also includes an outer layer that is a polyamide.

In an embodiment, the flexible multilayer film is a coextruded film and includes:

(i) a seal layer composed of an olefin-based polymer having a first melt temperature less than 105° C., (Tm1); and (ii) an outer layer composed of a polymeric material having a second melt temperature, (Tm2), wherein Tm2−Tm1>40° C.

The term "Tm2−Tm1" is the difference between the melt temperature of the polymer in the outer layer and the melt temperature of the polymer in the seal layer, and is also referred to as "ΔTm." In an embodiment, the ΔTm is from 41° C., or 50° C., or 75° C., or 100° C. to 125° C., or 150° C., or 175° C., or 200° C.

In an embodiment, the flexible multilayer film is a coextruded film; the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cc, or from 0.875 to 0.910 g/cc, or from 0.888 to 0.900 g/cc; and the outer layer is composed of a polyamide having a Tm from 170° C. to 270° C.

In an embodiment, the flexible multilayer film is a coextruded and/or laminated film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and a density from 0.865 to 0.925 g/cc, or from 0.875 to 0.910 g/cc, or from 0.888 to 0.900 g/cc; and an outermost layer composed of a material selected from LLDPE, OPET, OPP (oriented polypropylene), BOPP, polyamide, and combinations thereof.

In an embodiment, the flexible multilayer film is a coextruded and/or laminated film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cc, or from 0.875 to 0.910 g/cc, or from 0.888 to 0.900 g/cc. The outer layer is composed of a material selected from LLDPE, OPET, OPP (oriented polypropylene), BOPP, polyamide, and combinations thereof.

In an embodiment, the flexible multilayer film is a coextruded (or laminated) five layer film, or a coextruded (or laminated) seven layer film having at least two layers containing an ethylene-based polymer. The ethylene-based polymer may be the same or different in each layer.

In an embodiment, the flexible multilayer film is a coextruded (or laminated) five layer film, or a coextruded (or laminated) seven layer film having all layers containing polyolefin. The polyolefins may be the same or different in each layer. In such a case the entire package created with microcapillary strip included contains polyolefin.

In an embodiment, the flexible multilayer film is a coextruded (or laminated) five layer film, or a coextruded (or laminated) seven layer film having all layers containing an ethylene-based polymer. The ethylene-based polymer may be the same or different in each layer. In such a case the entire package created with microcapillary strip included contains polyethylene.

In an embodiment, the flexible multilayer film includes a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a heat seal initiation temperature (HSIT) from 65° C. to less than 125° C. Applicant discovered that the seal layer with an ethylene-based polymer with a HSIT from 65° C. to less than 125° C. advantageously enables the formation of secure seals and secure sealed edges around the complex perimeter of the flexible container. The ethylene-based polymer with HSIT from 65° C. to 125° C. enables lower heat sealing pressure/temperature during container fabrication. Lower heat seal pressure/temperature results in lower stress at the fold points of the gusset, and lower stress at the union of the films in the top segment and in the bottom segment. This improves film integrity by reducing wrinkling during the container fabrication. Reducing stresses at the folds and seams improves the finished container mechanical performance. The low HSIT ethylene-based polymer seals at a temperature below what would cause the microcapillary strip dimensional stability to be compromised.

In an embodiment, the flexible multilayer film is a coextruded and/or laminated five layer, or a coextruded (or laminated) seven layer film having at least one layer containing a material selected from LLDPE, OPET, OPP (oriented polypropylene), BOPP, and polyamide.

In an embodiment, the flexible multilayer film is a coextruded and/or laminated five layer, or a coextruded (or laminated) seven layer film having at least one layer containing OPET or OPP.

In an embodiment, the flexible multilayer film is a coextruded (or laminated) five layer, or a coextruded (or laminated) seven layer film having at least one layer containing polyamide.

In an embodiment, the flexible multilayer film is a seven-layer coextruded (or laminated) film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 106° C. The outer layer is a polyamide having a Tm from 170° C. to 270° C. The film has a ΔTm from 40° C. to 200° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

In an embodiment, flexible films 22, 24 each has a thickness from 50 micrometers (μm), or 75 μm, or 100 μm, or 150 μm, or 200 μm to 250 μm, or 300 μm, or 350 μm, or 400 μm.

3. Placing and Positioning the Microcapillary Strip

The opposing flexible films 22 and 24 are superimposed on each other and form a common peripheral edge 26, as shown in FIGS. 7-19. The common peripheral edge 26 defines a shape. The shape can be a polygon (such as triangle, square, rectangle, diamond, pentagon, hexagon, heptagon, octagon, etc.) or an ellipse (such as an ovoid, an oval, or a circle).

The present process includes placing the microcapillary strip 10 between the two opposing flexible films 22, 24, as shown in FIG. 8 (and FIG. 15). The flexible films 22, 24 may or may not be sealed prior to the placing step.

In an embodiment, a bottom seal 27 attaches the first flexible film 22 to the second flexible film 24 prior to the placing step.

In an embodiment, a pouch is partially formed prior to the placing step and includes a bottom gusset to form a stand up pouch.

4. Positioning the Microcapillary Strip

The process includes positioning a first side of the microcapillary strip at a first side of the common peripheral edge and positioning a second side of the microcapillary strip at a second side of the common peripheral edge.

Figure 9:
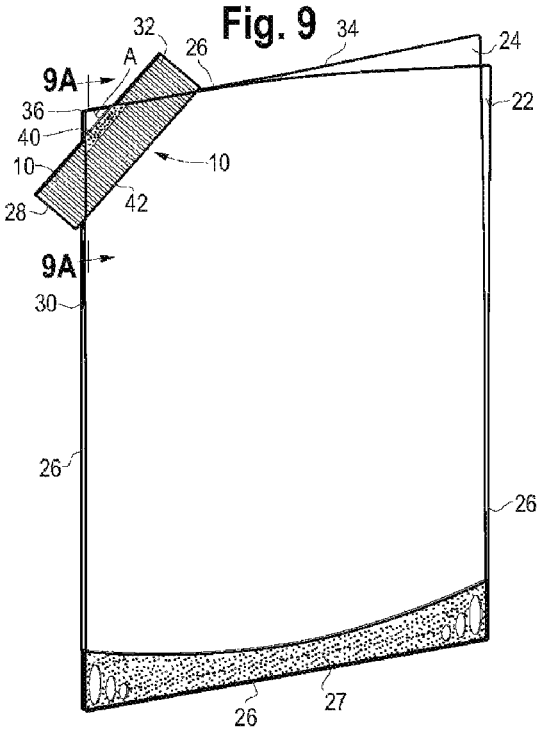
FIG. 9 is a perspective view of a microcapillary strip sealed between two flexible films in accordance with an embodiment of the present disclosure.

In an embodiment, the common peripheral edge 26 defines a polygon, such as a 4-sided polygon (rectangle, square, diamond), as shown in FIG. 8. In this embodiment, the process includes first positioning a first side 28 of the microcapillary strip 10 at a first side 30 of the 4-sided polygon. The process includes second positioning a second side 32 of the microcapillary strip 10 at an intersecting second side 34 of the 4-sided polygon. As shown in FIGS. 8-9, the second side 34 of the 4-sided polygon intersects the first side 30 of the 4-sided polygon, the intersection being corner 36.

The microcapillary strip 10 has an outer edge 40 (corresponding to first end 14) and an inner edge 42 (corresponding to second end 16). In an embodiment, the outer edge 40 forms angle A at the corner 36, as shown in FIG. 9. In a further embodiment, angle A is 45°.

Figure 16:
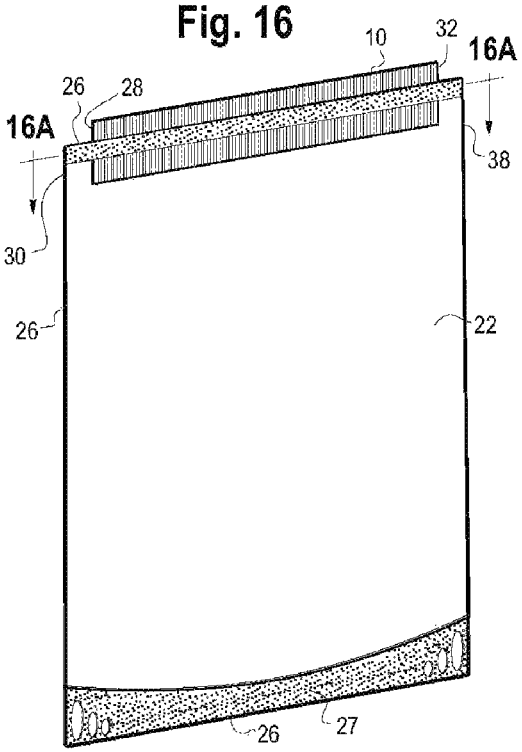
FIG. 16 is a perspective view of a microcapillary strip sealed between two flexible films in accordance with an embodiment of the present disclosure.

In an embodiment, the common peripheral edge 26 defines a polygon, such as a 4-sided polygon (rectangle, square, diamond) as shown in FIGS. 15 and 16. In this embodiment, the process includes first positioning a first side 28 of the microcapillary strip 10 at a first side 30 of the 4-sided polygon. The process includes second positioning a second side 32 of the microcapillary strip 10 at a parallel second side 38 of the 4-sided polygon. As shown in FIGS. 15 and 16, the first side 30 of the 4-sided polygon is parallel to, and does not intersect, the second side 38 of the 4-sided polygon.

The microcapillary strip 10 may or may not extend along the entire length of one side of the polygon. FIGS. 15-16 show an embodiment wherein the microcapillary strip 10 extends along only a portion of the length of one side of the polygon.

5. Sealing

The process includes first sealing, at a first sealing condition, the microcapillary strip 10 between the two flexible films 22, 24. The first sealing procedure forms a hermetic seal between the microcapillary strip 10 and each flexible film 22, 24. The first sealing condition simultaneously preserves the structure of the channels 20 of the microcapillary strip 10.

The first sealing can be an ultrasonic seal procedure, an adhesive seal procedure, a heat seal procedure, and combinations thereof.

In an embodiment, the first sealing is a heat sealing procedure. The term "heat sealing," as used herein, is the act of placing two or more films of polymeric material between opposing heat seal bars, the heat seal bars moved toward each other, sandwiching the films, to apply heat and pressure to the films such that opposing interior surfaces (seal layers) of the films contact, melt, and form a heat seal or weld to attach the films to each other. Heat sealing includes suitable structure and mechanism to move the seal bars toward and away from each other in order to perform the heat sealing procedure.

The first sealing occurs at a first seal condition. The first seal condition is sufficient (i) to form a hermetic seal between the microcapillary strip 10 and the first flexible film 22 and (ii) to form a hermetic seal between the microcapillary strip 10 and the second flexible film 24.

In an embodiment, the first heat seal condition includes a heat seal temperature that (1) is greater than the heat seal initiation temperature of the polymeric material in the sealant layer of the flexible films 22, 24 and (2) is less than the melting temperature, Tm, of the polymeric material of the matrix 18 for the microcapillary strip 10. The first seal condition includes a seal pressure that compresses the first film (22)/strip (10)/second film (24) configuration, but does not damage the structure of the microcapillary strip 10.

In an embodiment, the first seal condition includes a sealing temperature from 100° C. to 120° C., a sealing pressure from 0.1 N/cm$^2$ to 50 N/cm$^2$, and a dwell time from 0.1 seconds to about 2.0 seconds, or more.

Figure 9A:
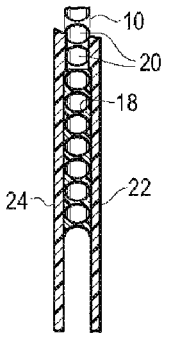
FIG. 9A is a sectional view taken along line 9A-9A of FIG. 9.
Figure 16A:
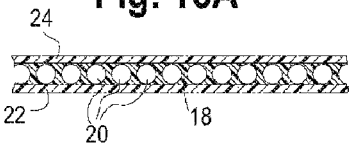
FIG. 16A is a sectional view taken along line 16A-16A of FIG. 16.

FIG. 9A and FIG. 16A are cross-sectional views of the first film (22)/strip (10)/second film (24) configuration after completion of the first sealing step. For the microcapillary strip, the structure of the matrix 18 and the channels 20 are intact. FIGS. 9 and 9A (and FIGS. 16 and 16A) show the microcapillary strip 10 after completion of the first sealing. The microcapillary strip 10 is sealed to, or otherwise attached to, the first flexible film 22 and is attached to the second flexible film 24. The microcapillary strip 10 is intact, and not damaged, with channels 20 open, as shown in FIG. 9A and in FIG. 16A.

The process includes second sealing, at a second seal condition, a peripheral seal 44 along at least a portion of the common peripheral edge 26. The resultant peripheral seal 44 includes a sealed microcapillary segment either 46*a*, or 46*b*.

The second sealing can be an ultrasonic seal procedure, an adhesive seal procedure, a heat seal procedure, and combinations thereof.

In an embodiment, the second sealing is a heat sealing procedure. The second sealing is performed at a second seal condition. The second seal condition includes (1) a heat seal temperature that is greater than or equal to the Tm of the polymeric material of matrix 18 and (2) a seal pressure that collapses or otherwise crushes a portion of the channels 20 of the microcapillary strip 10.

In an embodiment, the second seal condition includes a sealing temperature from 115° C. to 250° C., a sealing pressure from 20 N/cm$^2$ to 250 N/cm$^2$, and dwell time from 0.1 seconds to about 2.0 seconds, or more.

Figure 10:
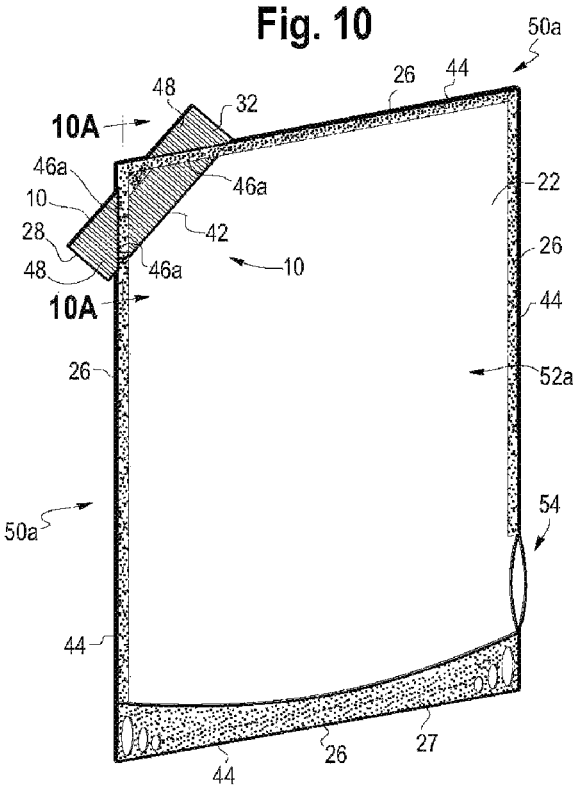
FIG. 10 is a perspective view of a flexible pouch having a peripheral seal and a sealed microcapillary segment in accordance with an embodiment of the present disclosure.
Figure 10A:
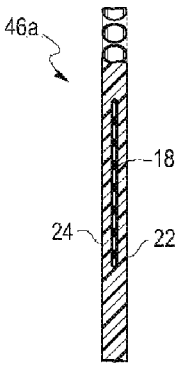
FIG. 10A is a sectional view taken along line 10A-10A of FIG. 10.

FIGS. 10 and 10A (and FIGS. 17 and 17A) show the first film (22)/strip (10)/second film (24) after completion of the second sealing step. In FIGS. 10 and 10A, the sealed microcapillary segment 46*a* includes a change in the structure of the microcapillary strip 10. At the sealed microcapillary segment 46*a* (sealed microcapillary segment 46*b* for FIGS. 17 and 17A), the matrix 18 is melted and sealed to films 22, 24 and the channels 20 are crushed, or otherwise collapsed. In this way, the sealed microcapillary segment 46*a* (and 46*b*) forms a closed and hermetic seal. The peripheral seal 44 includes the sealed microcapillary segments 46*a*, 46*b*, for a hermetic seal around the perimeter of the films 22, 24.

Excess microcapillary strip material 48 (FIGS. 10 and 17) that does not form part of the sealed microcapillary segment is removed.

6. Pouch

The second sealing forms a pouch 50*a* (FIGS. 10-14) and a pouch 50*b* (FIGS. 17-19) having respective storage compartment 52*a*, 52*b*. As the first film 22 and the second film 24 are flexible, so too is each pouch 50*a*, 50*b* a flexible pouch.

Figure 11:
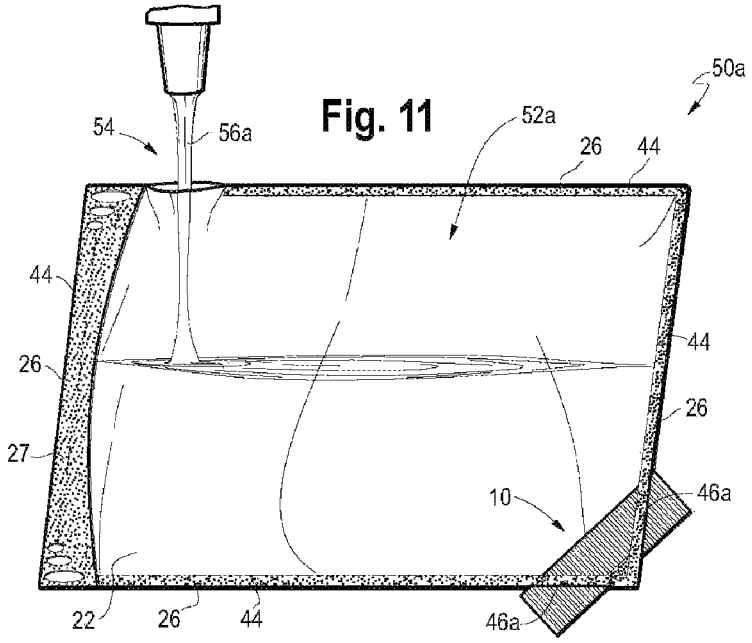
FIG. 11 is a perspective view of a filling step in accordance with an embodiment of the present disclosure.

In an embodiment, a portion of the common peripheral edge 26 remains unsealed after the second seal step. This unsealed area forms a fill inlet 54, as shown in FIGS. 10 and 11. The process includes filling, at the fill inlet 54, a liquid 56*a* (for pouch 50*a*) into the storage compartment 52*a*. The flexible pouch 50*b* can be filled with a liquid 56*b* in a similar manner. Nonlimiting examples of suitable liquids 56*a*, 56*b* include fluid comestibles (beverages, condiments, salad dressings, flowable food); liquid or fluid medicaments; aqueous plant nutrition; household and industrial cleaning fluids; disinfectants; moisturizers; lubricants; surface treatment fluids such as wax emulsions, polishers, floor and wood finishes; personal care liquids (such as oils, creams, lotions, gels); etc.

In an embodiment, the process includes third sealing the fill inlet 54, to form a peripheral seal 44, at the fill inlet 54. The third sealing step forms a closed and filled pouch 50*a*, 50*b*. In an embodiment, the third seal procedure utilizes heat seal conditions to form a hermetic seal at the fill inlet 54.

The third sealing can be an ultrasonic seal procedure, an adhesive seal procedure, a heat seal procedure, and combinations thereof.

In an embodiment, the third sealing is a heat sealing procedure. The heat seal conditions for the third sealing procedure can be the same as, or different than the first seal condition, or the second heat seal condition.

7. Dispensing

Figure 13:
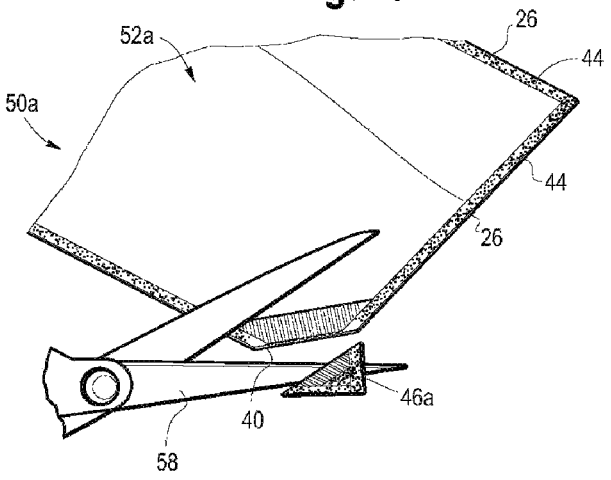
FIG. 13 is a perspective view of the removal of the sealed microcapillary segment in accordance with an embodiment of the present disclosure.
Figure 18:
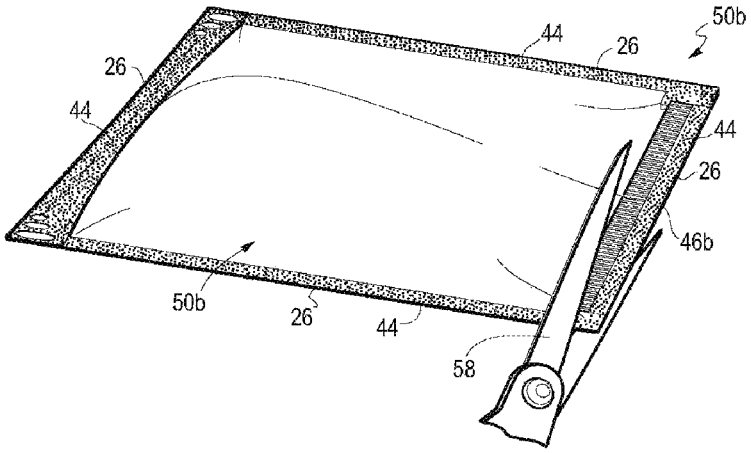
FIG. 18 is a perspective view of the removal of the sealed microcapillary segment in accordance with an embodiment of the present disclosure.

In an embodiment, the process includes removing at least a portion of the sealed microcapillary segment 46*a* (for pouch 50*a*) or sealed microcapillary segment 46*b* (for pouch 50*b*), to expose the outer edge of the channels 20. FIGS. 13 and 18 show the removal of respective portions of the sealed microcapillary segment 46*a* (FIG. 13) and 46*b* (FIG. 18). Removal can occur manually or by way of machine. In an embodiment, the removing step is performed manually (by hand), with a person cutting the sealed microcapillary segment 46*a*, 46*b* with a sharp object such as a blade, a knife, or a scissors 58, as shown in FIGS. 13 and 18.

Removal of the sealed microcapillary segment 46*a*, 46*b* exposes the outer edge 40 of the microcapillary strip 10 to the external environment. Once the sealed microcapillary segment 46*a*, 46*b* is removed from its respective pouch 50*a*, 50*b*, the exposed channels 20 place the interior of storage compartments 52*a*, 52*b* in fluid communication with exterior of respective flexible pouch 50*a*, 50*b*.

The process includes squeezing the storage compartment 52*a* (or 52*b*) to dispense the liquid (56*a*, 56*b*) through the channels 20 and out of the respective pouch 50*a*, 50*b*.

Figure 14:
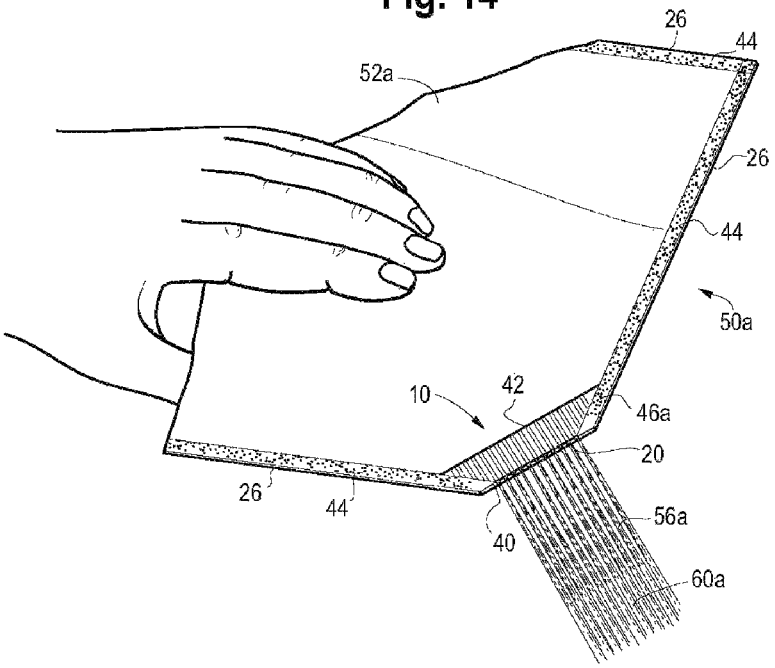
FIG. 14 is a perspective view of a dispensing step in accordance with an embodiment of the present disclosure.

In an embodiment, the process includes squeezing the storage compartment 52*a* and dispensing a spray pattern 60*a* of the liquid 56*a*, as shown in FIG. 14. The spray pattern 60*a* can be advantageously controlled by adjusting the amount of squeeze force imparted upon the storage compartment 52*a*. In this way, the flexible pouch 50*a* surprisingly delivers a controlled spray pattern 60*a* of liquid 56*a* without the need for a rigid spray component. The profile of spray 60*a* can be designed by the configuration or arrangement of the channels 20. Channels 20 with a relatively smaller diameter, D, will dispense a fine spray of the liquid 56*a* when compared to channels 20 with a relatively larger diameter, D. FIG. 14 shows the dispensing of a low viscous liquid 56*a* (such as a water-based liquid) as a fine and controlled spray 60*a*.

Figure 19:
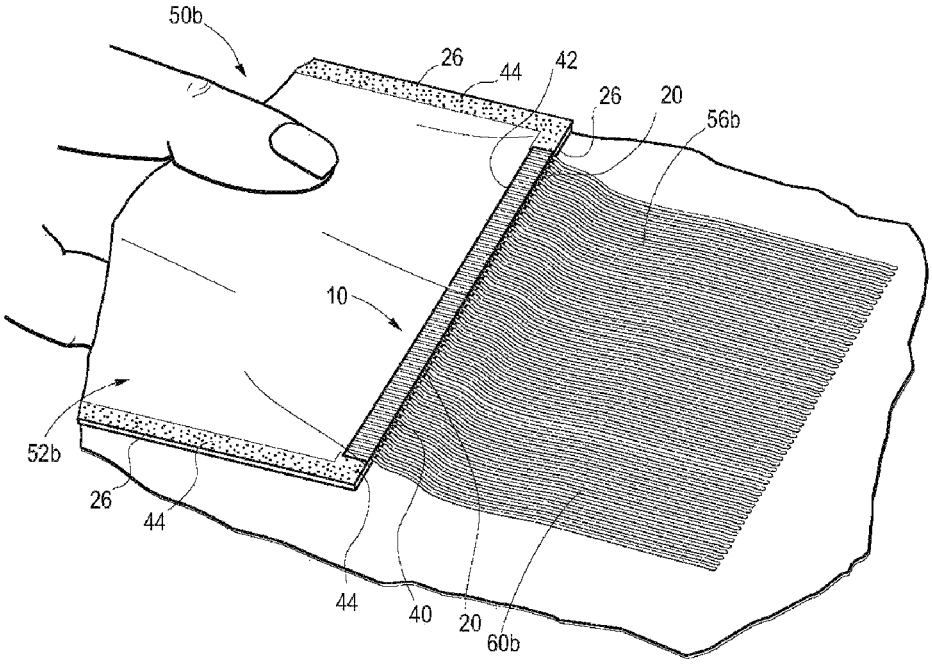
FIG. 19 is a perspective view of a dispensing step in accordance with an embodiment of the present disclosure.

In an embodiment, the process includes squeezing the storage compartment 52*b* of pouch 50*b* and dispensing a spray pattern 60*b* of the liquid 56*b*, as shown in FIG. 19. The spray pattern 60*b* can be advantageously controlled by adjusting the amount of squeeze force imparted upon the storage compartment 52*b*. In this way, the flexible pouch 50*b* surprisingly delivers a controlled application of liquid 56*b* without the need for a rigid spray component. The diameter, D, of the channels 20 are configured so the profile of spray 60*b* delivers, or otherwise dispenses, a smooth and even application of a viscous liquid 56*b*, such as a lotion or a cream onto a surface, such as a person's skin, as shown in FIG. 19.

The present disclosure provides another process. In an embodiment, a process for producing a flexible pouch is provided and includes placing a microcapillary strip at an edge offset distance between two opposing flexible films. The flexible films define a common peripheral edge. The process includes positioning a first side of the microcapillary strip at a first side of the common peripheral edge and positioning a second side of the microcapillary strip at a second side of the common peripheral edge. The process includes first sealing, at a first seal condition, the microcapillary strip between the two flexible films. The process includes second sealing, at a second seal condition, a peripheral seal along at least a portion of the common peripheral edge, the peripheral seal comprising a sealed microcapillary segment.

8. Edge Offset Distance

The process includes placing the microcapillary strip 110 at an edge offset distance between two opposing flexible films 122, 124, as shown in FIGS. 20-29. Films 122, 124 may by any flexible film as previously disclosed herein. The edge offset distance, or EOD, is a length from the common peripheral edge 126 to an interior portion of the films 122, 124. The edge offset distance, EOD, can be from greater than zero millimeters (mm), or 1 mm, or 1.5 mm, or 2.0 mm, or 2.5 mm, or 3.0 mm, or 3.5 mm to 4.0 mm, or 4.5 mm, or 5.0 mm, or 6.0 mm, or 7.0 mm, or 9.0 mm, or 10.0 mm, or 15.0 mm, or 20.0 mm, or 40.0 mm, or 60.0 mm, or 80.0 mm, or 90.0 mm, or 100.0 mm.

FIGS. 20-25 show an embodiment, wherein the microcapillary strip 110 is placed at an edge offset distance, EOD, between opposing flexible films 122, 124, and the films define a common peripheral edge 126. The distance from the corner 136 to the outer edge 140 of the microcapillary strip is the edge offset distance, shown as length EOD in FIGS. 20 and 21. In an embodiment, the EOD is from greater than 0 mm, or 1.0 mm, or 1.5 mm, or 2.0 mm, or 3.0 mm, or 4.0 mm, or 5.0 mm, or 10.0 mm to 15.0 mm, or 20.0 mm, or 25.0 mm, or 30 mm.

Figure 20:
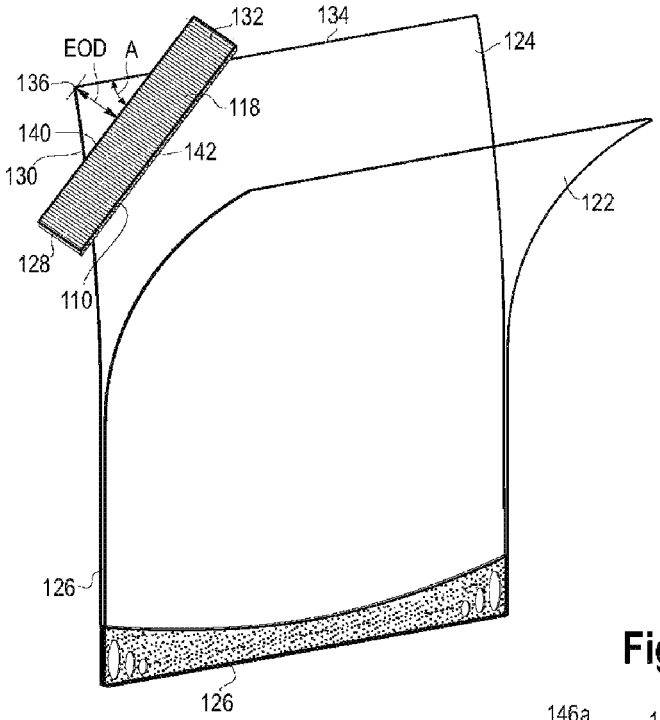
FIG. 20 is a perspective view of a microcapillary strip placed at an offset distance between two flexible films in accordance with an embodiment of the present disclosure.
Figure 21:
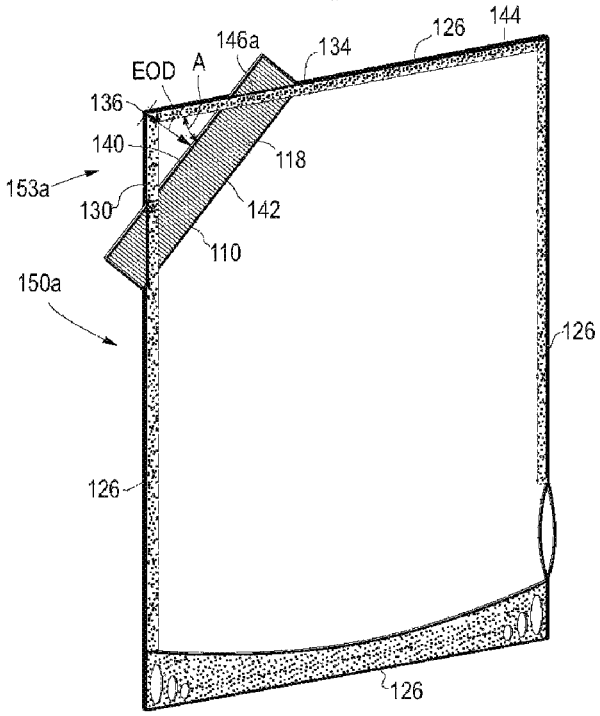
FIG. 21 is a perspective view of a microcapillary strip sealed between two flexible films in accordance with an embodiment of the present disclosure.
Figure 22:
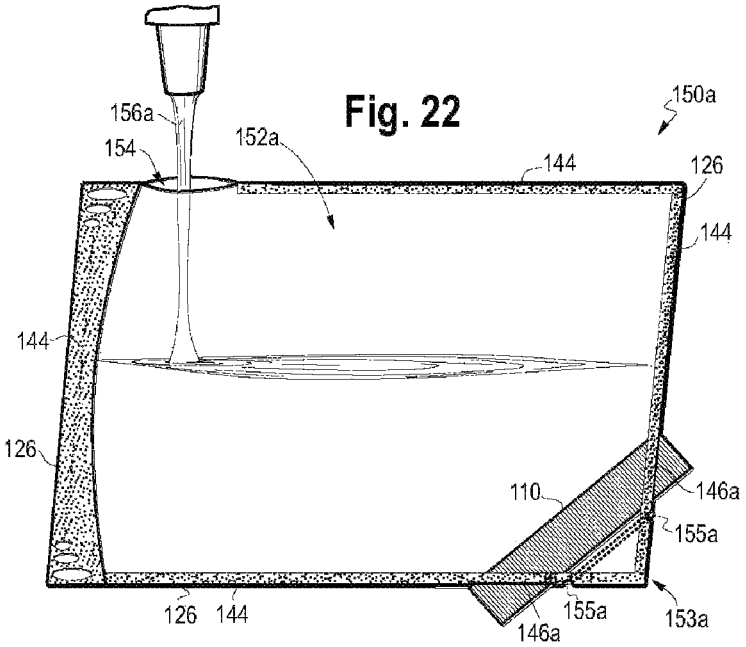
FIG. 22 is a perspective view of a filling step in accordance with an embodiment of the present disclosure.
Figure 23:
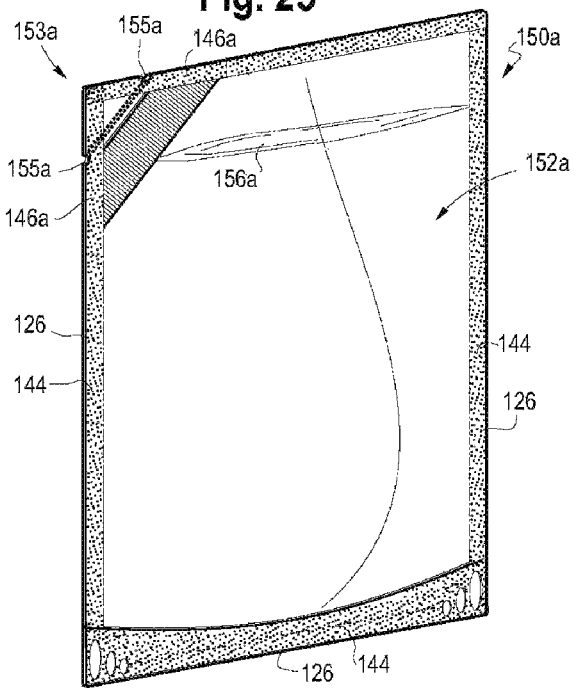
FIG. 23 is a perspective view of a filled and sealed flexible pouch in accordance with an embodiment of the present disclosure.
Figure 24:
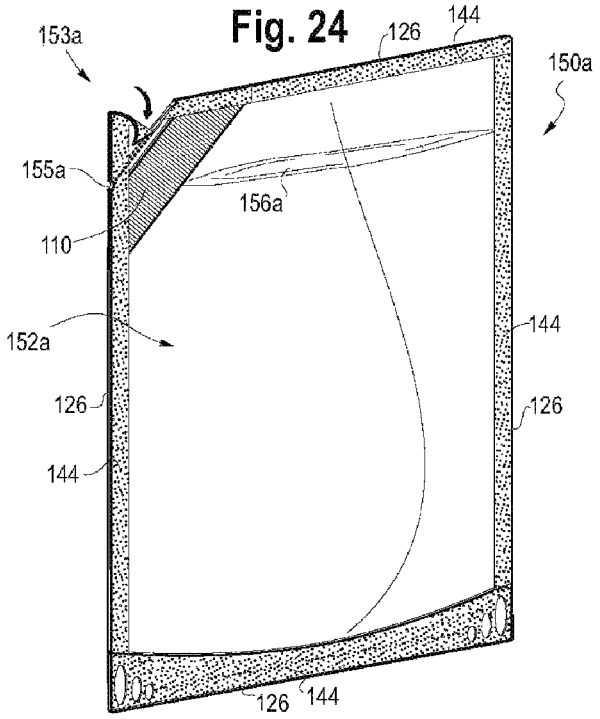
FIG. 24 is a perspective view of the removal of a pocket in accordance with an embodiment of the present disclosure.

A first side of the microcapillary strip 110 is positioned at a first side of the common peripheral edge and a second side of the microcapillary strip 110 is positioned at a second side of the common peripheral edge. The common peripheral edge 126 defines a 4-sided polygon (rectangle, square, diamond). The process includes first positioning a first side 128 of the microcapillary strip 110 at a first side 130 of the 4-sided polygon. The process includes second positioning a second side 132 of the microcapillary strip 110 at an intersecting second side 134 of the 4-sided polygon. As shown in FIGS. 20-22, the second side 134 of the 4-sided polygon intersects the first side 130 of the 4-sided polygon, the intersection being corner 136.

The microcapillary strip 110 has an outer edge 140 and an inner edge 142. In an embodiment, the outer edge 140 forms angle A at the corner 136, as shown in FIGS. 20 and 21. In a further embodiment, angle A is 45°.

FIGS. 26-29 shows another embodiment, wherein the microcapillary strip 110 is placed at an edge offset distance, EOD. From the top common peripheral edge 126, to the outer edge 140 of the microcapillary strip 10, the EOD is from 5 mm to 50 mm.

Figure 26:
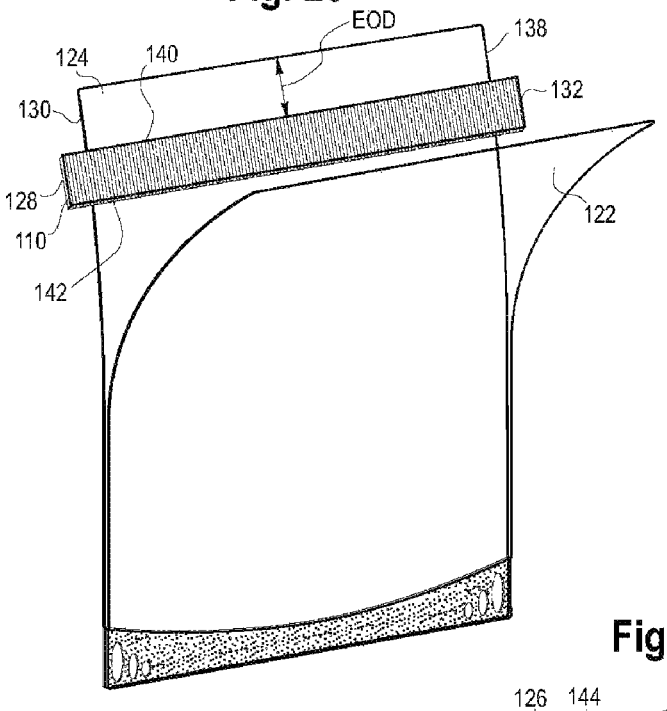
FIG. 26 is a perspective view of a microcapillary strip placed at an offset distance between two flexible films in accordance with an embodiment of the present disclosure.
Figure 27:
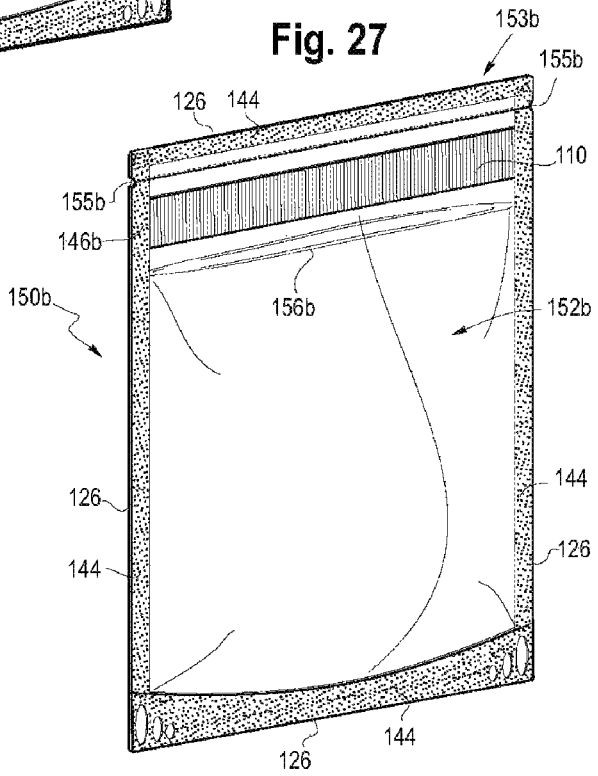
FIG. 27 is a perspective view of a filled and sealed flexible pouch in accordance with an embodiment of the present disclosure.
Figure 28:
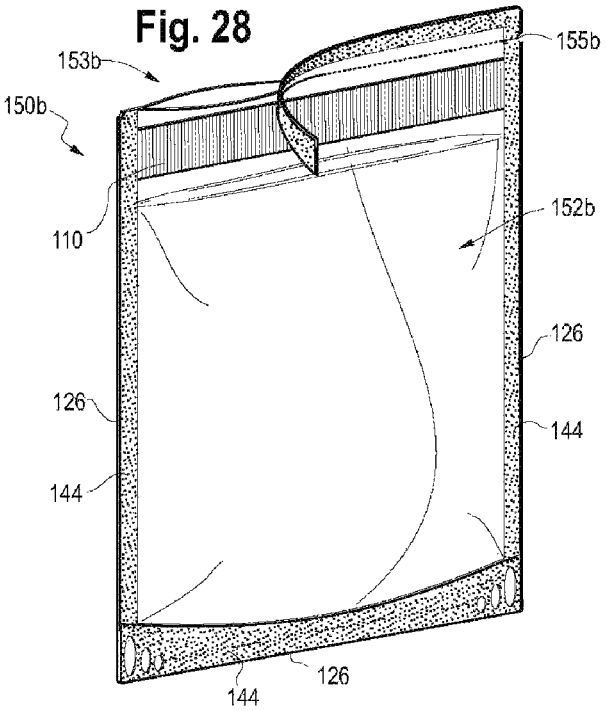
FIG. 28 is a perspective view of the removal of a pocket in accordance with an embodiment of the present disclosure.

The process includes first positioning a first side 128 of the microcapillary strip 110 at a first side 130 of the 4-sided polygon. The process includes second positioning a second side 132 of the microcapillary strip 110 at a parallel second side 138 of the 4-sided polygon. As shown in FIGS. 26 and 27, the first side 130 of the 4-sided polygon is parallel to, and does not intersect, the second side 138 of the 4-sided polygon.

9. Sealing

The process includes first sealing, at a first sealing condition, the microcapillary strip 110 between the two flexible films 122, 124. The first sealing procedure forms a hermetic seal between the microcapillary strip 110 and each flexible film 122, 124. The first sealing condition simultaneously preserves the structure of the matrix 118 and the channels 120 of the microcapillary strip 110.

The first sealing can be any first sealing procedure at first seal conditions as previously disclosed herein.

The process includes second sealing, at a second seal condition, a peripheral seal 144 along at least a portion of the common peripheral edge 126. The resultant peripheral seal 144 includes a sealed microcapillary segment 146*a*, for FIGS. 20-25 (and 146*b* for FIGS. 26-29). The second sealing can be any second sealing procedure with any second sealing condition as previously disclosed herein.

In an embodiment, the process includes forming, with the second sealing, a flexible pouch 150*a* or 150*b* having a respective storage compartment 152*a*, 152*b* and a respective pocket 153*a*, 153*b*. The microcapillary strip 110 separates the storage compartment from the pocket.

In an embodiment, the flexible pouch includes a fill inlet 154 at an unsealed portion of the common peripheral edge 126. FIG. 22 shows the process of filling a liquid 156*a* through the fill inlet 154 and into the storage compartment 152*a*. Storage compartment 152*b* can be filled with a liquid 156*b* in a similar manner.

In an embodiment, the process includes third sealing the fill inlet 154 and forming a closed and filled flexible pouch. The third sealing can include any third sealing procedure as previously disclosed herein.

In an embodiment, the process includes removing the pocket to expose the outer edge of the channels 120. Once the pocket is removed from the pouch, the exposed channels 120 of the microcapillary strip 110 place the interior of the storage compartment in fluid communication with exterior of the pouch.

FIGS. 20-25 show an embodiment wherein pouch 150*a* includes a corner pocket 153*a*. Cut-outs 155*a* in the peripheral seal 144 enable ready removal of the corner pocket 153*a*. In an embodiment, the removing step includes tearing, by hand, the corner pocket 153*a* from the pouch 150*a*.

FIGS. 26-29 show another embodiment wherein pouch 150*b* includes a long pocket 153*b*. Cut-outs 155*b* in the peripheral seal 144 enable ready removal of the long pocket 153*b*. In an embodiment, the process includes tearing, by hand, the long pocket 153*b* from the pouch 150*b*.

Alternatively, the removing of the pocket (either 153*a*, or 153*b*) can be accomplished with sharp object such as a blade, a knife, or a scissors.

Once the pocket is removed from the pouch, an embodiment includes squeezing the storage compartment and dispensing, through the microcapillaries, the liquid from the pouch.

Figure 25:
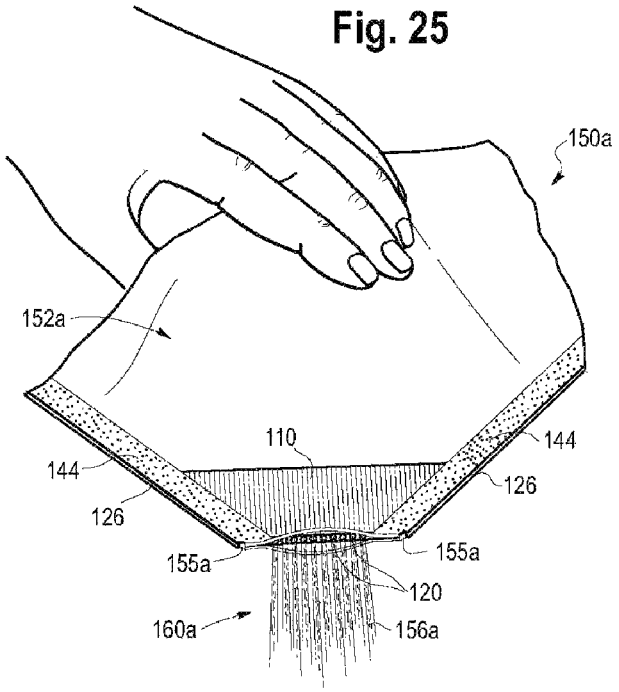
FIG. 25 is a perspective view of a dispensing step in accordance with an embodiment of the present disclosure.

The process includes squeezing the storage compartment to dispense the liquid through the exposed channels 120 and out of the pouch. In an embodiment, the process includes squeezing the storage compartment 152*a* and dispensing from the pouch 150*a*, a spray pattern 160*a* of the liquid 156*a*, as shown in FIG. 25. FIG. 25 shows the dispensing of a low viscosity liquid 156*a* (such as a water-based liquid) as a fine and controlled spray. The spray pattern 160*a* and the spray flow intensity can be advantageously controlled by adjusting the amount of squeeze force imparted upon the storage compartment 152*a* as previously discussed. In this way, the flexible pouch 150*a* surprisingly and advantageously provides a flexible pouch and dispensing system that can be operated entirely by hand—i.e., hand removal of corner pocket 153*a*, and hand control (squeeze) of spray pattern 160*a*.

Figure 29:
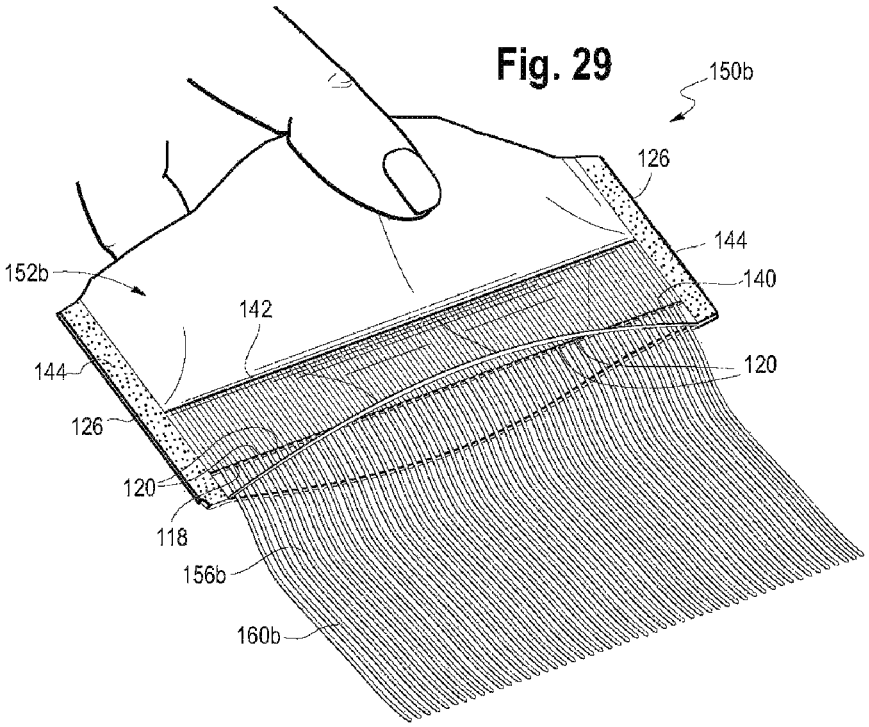
FIG. 29 is a perspective view of a dispensing step in accordance with an embodiment of the present disclosure.

In an embodiment, the process includes squeezing the storage compartment 152*b* of pouch 150*b* and dispensing a spray pattern 160*b* of a viscous liquid 156*b*, such as a lotion or a cream onto a surface, such as a person's skin, as shown in FIG. 29. The spray pattern 160*b* and the spray flow intensity can be advantageously controlled by adjusting the amount of squeeze force imparted upon the storage compartment 152*b* as previously discussed. In this way, the flexible pouch 150*b* surprisingly and advantageously provides a flexible pouch and dispensing system for a high viscosity liquid (lotion, cream, paste, gel) that can be operated entirely by hand—i.e., hand removal of long pocket 153*b*, hand control (squeeze) of spray pattern 160*b*).

By way of example, and not limitation, examples of the present disclosure are provided.

EXAMPLES

Flexible multilayer films with structure shown in Table 1 below are used in the present examples.

1. Multilayer Film

TABLE 1

Composition of the Flexible Multilayer Film (Film 1)
Laminated Multilayer Film

| Material | Description | Density ($g/cm^3$) ASTM D792 | Melt Index (g/10 min) ASTM D1238 (190° C./2.16 kg) | Melting Point (° C.) DSC | Thickness (micrometer) |
|---|---|---|---|---|---|
| LLDPE | Dowlex ™ 2049 | 0.926 | 1 | 121 | 20 |
| HDPE | Elite ™ 5960G | 0.962 | 0.85 | 134 | 20 |
| LLDPE | Elite ™ 5400G | 0.916 | 1 | 123 | 19 |
| Adhesive Layer | Polyurethane solvent less adhesive (ex. Morfree 970/CR137) | | | | 2 |
| HDPE | Elite ™ 5960G | 0.962 | 0.85 | 134 | 19 |
| HDPE | Elite ™ 5960G | 0.962 | 0.85 | 134 | 20 |
| Seal Layer | Affinity ™ 1146 | 0.899 | 1 | 95 | 20 |
| | | Total | | | 120 |

2. Flexible Stand-Up Pouch Made with Microcapillary Strip (Example 1)

A. Microcapillary Strip

A microcapillary strip is made using Dow/Cambridge technology according to technology described in U.S. Pat. No. 8,641,946.

Microcapillary Strip dimensions: approximately 2 cm by 5 cm

Thickness: 0.50 mm

Channel shape: oval approximately 1.00 mm width by 0.3 mm height

Channel spacing: 0.10 mm

The polymeric material for the microcapillary strip is a blend: ELITE™ 5100/LDPE 5011 (80/20, wt %). ELITE™ 5100 has density of 0.92 g/cc, MI of 0.85 g/10 min with Tm=124° C. LDPE 5011 has density of 0.92 g/cc, MI of 1.90 g/10 min and Tm=111° C.

B. Process

1. Two opposing films of Film 1 are provided with the seal layers facing each other and arranged to form a common peripheral edge. The microcapillary strip is placed between the two opposing Film 1 films at approximately 45° angle at the top left corner of the pouch. The microcapillary strip is first heat sealed for 0.5 seconds at 115° C. at 70 N, in a Brugger HSG-C heat sealer equipped with Teflon coated heat seal bar measuring 6 mm by 150 mm. The first heat sealing results in complete adhesion of the microcapillary strip outer surfaces to the seal layers films inner surfaces without significant changes of the microcapillary structure as observed with a microscope.

2. The pouch is filled with tap water through the corner (which is left open) opposite to the microcapillary strip. The pouch is filled to 75% of the maximum pouch volume.

Figure 12:
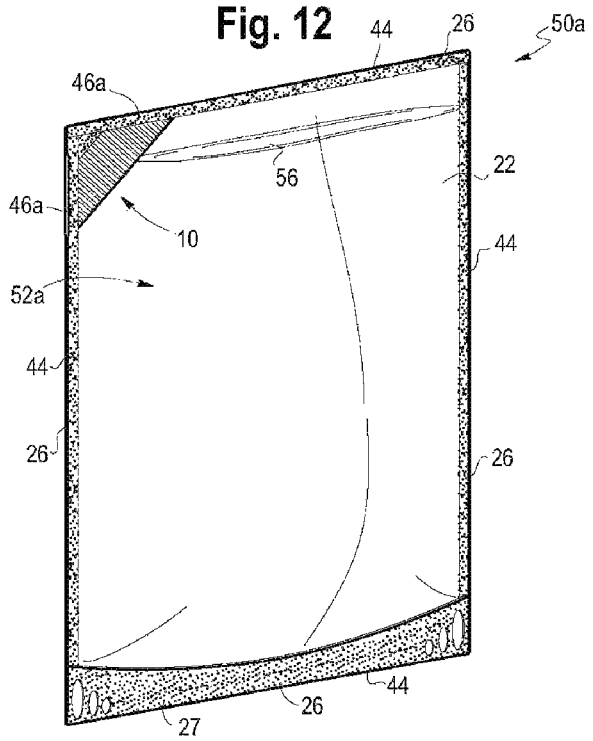
FIG. 12 is a perspective view of a filled and sealed flexible pouch in accordance with an embodiment of the present disclosure.

3. The water-filled pouch is closed by second heat sealing the common peripheral edge with the same Brugger HSG-C heat sealer equipped with a Teflon coated heat seal bar measuring 6 mm by 150 mm at 130° C. and 900 N of seal force corresponding to a pressure of 100 $N/cm^2$. The second heat sealing temperature is above the melting temperature, Tm, of the microcapillary strip and above the Tm of the Film 1 seal layer. The second seal force is 100 $N/cm^2$ and is sufficient to collapse the channels at the peripheral edge and completely seal the pouch. The filled and sealed flexible pouch with finished packaging corner with microcapillary strip installed is shown in FIG. 12 (Pouch 1).

4. Excess material left over from the microcapillary strips during the sealing process is trimmed to finish the packaging.

C. Functionality Demonstration

The corner of the flexible pouch is cut off using a regular scissors intersecting the microcapillary strip, exposing the edges of the channels. The pouch is gently squeezed by hand and a fine spray of water is dispensed from Pouch 1 as shown in FIG. 14.

3. Flexible Sachet Made with Microcapillary Strip (Example 2)

A. Microcapillary Strip

The same microcapillary strip used in example 1 is utilized for this example.

Strip dimensions: approximately 1 cm by 5 cm

Thickness: 0.50 mm

Channel shape: oval approximately 1.00 mm width by 0.3 mm height

Channel spacing: 0.10 mm

B. Process

1. The microcapillary strip is placed between two opposing pieces of Film 1. The seal layers face each other and the two Film 1 films are arranged to form a common peripheral edge. Each piece of Film 1 measures approximately 2.5 cm (short side) by 10 cm (long side). The microcapillary strip is placed between the opposing Film 1 films, parallel to, and along, the short side. The microcapillary strip is first heat sealed for 0.5 seconds at 115° C. at 70 N, in a Brugger HSG-C heat sealer equipped with Teflon coated heat seal bar measuring 6 mm by 150 mm.

2. A sachet is formed by second heat sealing three sides in the same Brugger HSG-C heat sealer equipped with a Teflon coated heat seal bar measuring 6 mm by 150 mm at 130° C. and 900 N of seal force which corresponds to 100 $N/cm^2$. The side opposite the microcapillary strip (the fill end) is left open. The second sealing temperature is above the Tm of the microcapillary strip and above the Tm of seal layer. The second seal force is 100 $N/cm^2$ and is sufficient to collapse the channels at the peripheral edge and completely seal the sachet.

3. The sachet is filled with white toothpaste by way of a syringe up to an approximate 5 cc volume.

4. The sachet is closed by third heat sealing the fill end utilizing the same seal conditions as the second heat seal conditions. The sides are tested for leakage by gently compressing the sachet. No leaks are detected.

5. Excess material left over from the microcapillary strip during the sealing process is trimmed to form the finished packaging with microcapillary strip installed as shown in FIG. 18.

Figure 17:
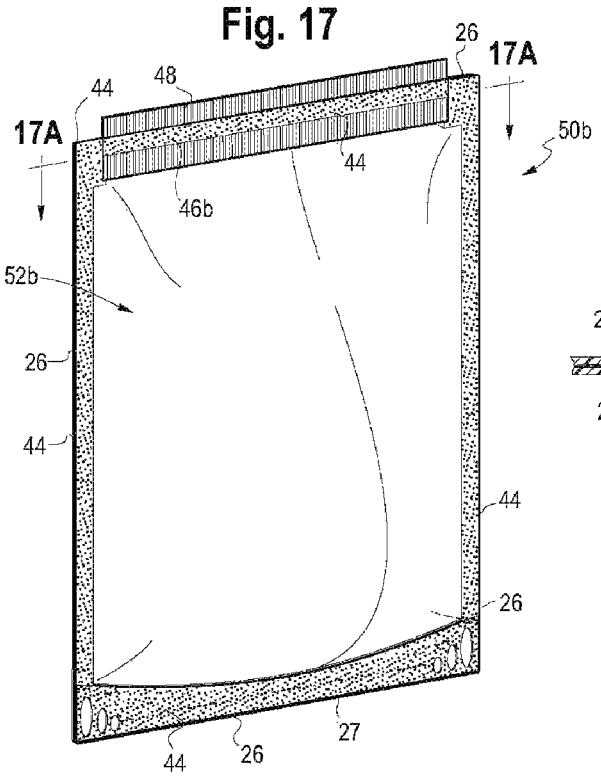
FIG. 17 is a perspective view of a pouch having a peripheral seal and a sealed microcapillary segment in accordance with an embodiment of the present disclosure.
Figure 17A:
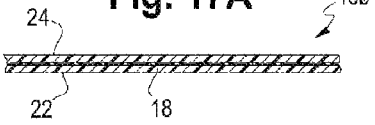
FIG. 17A is a sectional view taken along line 17A-17A of FIG. 17.

FIGS. 16 and 16A show the microcapillary sachet end before heat sealing the peripheral edge of the sachet. The collapsed and closed channels that form the sealed microcapillary segment are shown in FIG. 17A.

FIG. 18 shows the finished sachet. The FIG. 18 sachet is a hermetically sealed and closed flexible pouch with a microcapillary strip.

FIG. 19 shows the spreading pattern of liquid dispensed from the microcapillary sachet when a portion of the sealed microcapillary segment is removed.

C. Functionality Demonstration

The end of the sachet is cut off using a regular scissors intersecting the microcapillary strip, exposing the edges of the channels. The sachet is gently squeezed by hand over a surface and the content (toothpaste) is spread uniformly on the surface according to the channel array pattern (FIG. 19).

It is specifically intended that the present disclosure not be limited to the embodiments and illustrations contained herein, but include modified forms of those embodiments including portions of the embodiments and combinations of elements of different embodiments as come within the scope of the following claims.

We claim:

1. A process for producing a flexible pouch comprising:

placing a microcapillary strip between two opposing flexible films, the films defining a common peripheral edge;

positioning a first side of the microcapillary strip at a first side of the common peripheral edge and positioning a second side of the microcapillary strip at a second side of the common peripheral edge;

first sealing, at a first seal condition, the microcapillary strip between the two flexible films; and second sealing, at a second seal condition, a peripheral seal along at least a portion of the common peripheral edge, the peripheral seal comprising a sealed microcapillary segment.

2. The process of claim 1 comprising forming, with the second sealing, a flexible pouch having a storage compartment.

3. The process of claim 2 wherein the flexible pouch comprises a fill inlet at an unsealed portion of the common peripheral edge, the process comprising filling, through the fill inlet, the storage compartment with a liquid.

4. The process of claim 3 comprising third sealing the fill inlet and forming a closed and filled flexible pouch.

5. The process of claim 3 comprising removing a portion of the sealed microcapillary segment;

exposing outer edges of channels present in the microcapillary strip;

squeezing the storage compartment; and dispensing, through the channels, the liquid from the flexible pouch.

6. The process of claim 5 wherein the removing comprises cutting the portion of the sealed microcapillary segment from the flexible pouch.

7. The process of claim 1, wherein the common peripheral edge defines a 4-sided polygon, the process comprising first positioning the first side of the microcapillary strip at a first side of the 4-sided polygon; and second positioning the second side of the microcapillary strip at an intersecting side of the 4-sided polygon.

8. The process of claim 1, wherein the common peripheral edge defines a 4-sided polygon, the process comprising first positioning the first side of the microcapillary strip at a first side of the 4-sided polygon; and second positioning the second side of the microcapillary strip at a parallel side of the 4-sided polygon.

9. A process for producing a flexible container comprising:

placing a microcapillary strip at an edge offset distance between two opposing flexible films, the films defining a common peripheral edge;

positioning a first side of the microcapillary strip at a first side of the common peripheral edge and positioning a second side of the microcapillary strip at a second side of the common peripheral edge;

first sealing, at a first seal condition, the microcapillary strip between the two flexible films; and second sealing, at a second seal condition, a peripheral seal along at least a portion of the common peripheral edge, the peripheral seal comprising a sealed microcapillary segment.

10. The process of claim 9 comprising forming, with the second sealing, a flexible pouch having a storage compartment and a pocket.

11. The process of claim 10 wherein the flexible pouch comprises a fill inlet at an unsealed portion of the common peripheral edge, the process comprising filling, through the fill inlet, the storage compartment with a liquid.

12. The process of claim 11 comprising third sealing the fill inlet and forming a closed and filled flexible pouch.

13. The process of claim 11 comprising removing the pocket from the pouch;

exposing outer edges of channels present in the microcapillary strip;

squeezing the storage compartment; and dispensing, through the channels, the liquid from the pouch.

14. The process of claim 13 wherein the removing comprises hand tearing the pocket from the pouch.

15. The process of claim 9, wherein the common peripheral edge defines a 4-sided polygon, the process comprising first positioning the first side of the microcapillary strip at a first side of the 4-sided polygon; and second positioning the second side of the microcapillary strip at an intersecting side of the 4-sided polygon.

16. The process of claim 9, wherein the common peripheral edge defines a 4-sided polygon, the process comprising first positioning the first side of the microcapillary strip at a first side of the 4-sided polygon; and second positioning the second side of the microcapillary strip at a parallel side of the 4-sided polygon.

* * * * *